US011873822B2

(12) United States Patent
Nakaniwa et al.

(10) Patent No.: US 11,873,822 B2
(45) Date of Patent: Jan. 16, 2024

(54) CENTRIFUGAL COMPRESSOR

(71) Applicant: MITSUBISHI HEAVY INDUSTRIES COMPRESSOR CORPORATION, Tokyo (JP)

(72) Inventors: Akihiro Nakaniwa, Tokyo (JP); Jo Masutani, Tokyo (JP); Shinichiro Tokuyama, Hiroshima (JP); Yoshiaki Shoji, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 18/161,281

(22) Filed: Jan. 30, 2023

(65) Prior Publication Data

US 2023/0258190 A1 Aug. 17, 2023

(30) Foreign Application Priority Data

Feb. 16, 2022 (JP) ..... 2022-022079

(51) Int. Cl.
*F04D 17/12* (2006.01)
*F04D 29/44* (2006.01)
*F04D 29/42* (2006.01)

(52) U.S. Cl.
CPC ..... *F04D 17/122* (2013.01); *F04D 29/4206* (2013.01); *F04D 29/444* (2013.01)

(58) Field of Classification Search
CPC ..... F04D 17/12; F04D 17/122; F04D 29/286; F04D 29/4206; F04D 29/441; F04D 29/444; F04D 27/023; F04D 29/682; F05D 2260/602
See application file for complete search history.

(56) References Cited

U.S. PATENT DOCUMENTS 10,871,164 B2 * 12/2020 Yamashita ..... F04D 17/125
2011/0280710 A1 * 11/2011 Mariotti ..... F04D 17/14 415/65
2018/0372121 A1 * 12/2018 Higuchi ..... F04D 29/4206
2019/0136869 A1 * 5/2019 Matsueda ..... F04D 29/4206

FOREIGN PATENT DOCUMENTS

JP S64-051794 U 3/1989
JP H09273495 A * 10/1997 ..... F04D 29/44
JP 3432674 B2 8/2003

* cited by examiner

*Primary Examiner* — Woody A Lee, Jr.
*Assistant Examiner* — Eric A Lange
(74) *Attorney, Agent, or Firm* — Osha Bergman Watanabe & Burton LLP

(57) ABSTRACT

A centrifugal compressor includes a rotary shaft having a plurality of impellers and a casing having an intermediate discharge port. The casing has a plurality of diaphragms, an external casing, a return flow path that guides a flow direction of a working fluid to an inner side in a radial direction, and an intermediate scroll that guides part of the working fluid discharged from the impeller in an intermediate stage to the intermediate discharge port. The intermediate scroll has a scroll flow path formed on a second side in the axial direction with respect to the return flow path, and an introduction portion connecting the return flow path and the scroll flow path, and an outer flow path forming surface of the scroll flow path is formed by a casing inner peripheral surface facing an inner side of the external casing in the radial direction.

5 Claims, 4 Drawing Sheets

CENTRIFUGAL COMPRESSOR

BACKGROUND OF THE INVENTION

Field of the Invention

The present disclosure relates to a centrifugal compressor.

Priority is claimed on Japanese Patent Application No. 2022-22079, filed on Feb. 16, 2022, the content of which is incorporated herein by reference.

Description of Related Art

As a kind of centrifugal rotary machine, a multi-stage centrifugal compressor with multiple stages of impellers for compressing gas is known. The multi-stage centrifugal compressor sequentially compresses gas sucked into a casing from a suction port with the multi-stage impeller and discharges the gas from a discharge port to the outside of the casing.

In such a multi-stage centrifugal compressor, a structure in which an intermediate discharge port is provided between the suction port and the discharge port is known. For example, Patent Document 1 discloses a multi-stage centrifugal compressor including a casing having a suction port, a discharge port, and an intermediate discharge port, a rotary shaft disposed in the casing and extending in an axial direction, a plurality of impellers fixed to the rotary shaft, a diffuser disposed on an outer side of each impeller in the radial direction, and a return flow path disposed downstream of the diffuser. This multi-stage centrifugal compressor includes an annular extraction port that extracts part of the gas boosted by the impeller in the intermediate stage, and an intermediate scroll (collecting pipe) that collects the flow of the extracted gas and guides it to the intermediate discharge port. The intermediate scroll is disposed on a radially outer peripheral side of a curved portion from the diffuser to the return flow path and axially between the return flow path and the diffuser.

CITATION LIST

Patent Document

[Patent Document 1] Japanese Patent No. 3432674

SUMMARY OF THE INVENTION

However, in a configuration described in Patent Document 1, the intermediate scroll is disposed on the outer side of the curved portion in the radial direction from the diffuser to the return flow path. This leads to an increase in a diameter of the casing, which hinders miniaturization of the multi-stage centrifugal compressor. On the other hand, in a case where the intermediate scroll is disposed on an inner side of the curved portion in the radial direction of the curved portion of the return flow path, depending on its position, a change in flow direction of a working fluid discharged from the diffuser may be increased, and the pressure loss may be increased.

The present disclosure provides a centrifugal compressor capable of reducing the diameter of the casing while suppressing the pressure loss in the intermediate scroll.

A centrifugal compressor according to the present disclosure including: a rotary shaft extending in an axial direction in which a central axis extends; and a casing having a suction port formed on a first side in the axial direction in the casing, a discharge port formed on a second side in the axial direction in the casing, and an intermediate discharge port formed between the suction port and the discharge port in the axial direction, in which the rotary shaft has a plurality of impellers that are disposed in the casing at a distance in the axial direction, that configured to compress a working fluid supplied from the first side in the axial direction with respect to each of the plurality of impellers, and that configured to discharge the working fluid to an outer side in a radial direction with the central axis as a reference with respect to the each of the plurality of impellers, the casing has a plurality of diaphragms formed in a tubular shape extending in the axial direction to cover the each of the plurality of impellers, an external casing formed in a tubular shape extending in the axial direction to cover the plurality of diaphragms, a return flow path that configured to guide the working fluid, which is discharged from each of the plurality of impellers and is flowing toward the outer side in the radial direction, so that a flow direction of the working fluid is directed to an inner side in the radial direction, and an intermediate scroll that configured to guide part of the working fluid discharged from one of the plurality of impellers in an intermediate stage which is disposed midway in the axial direction among the plurality of impellers to the intermediate discharge port, the intermediate scroll has a scroll flow path formed on the second side in the axial direction with respect to the return flow path, extending in a circumferential direction around the central axis, and connected to the intermediate discharge port at part of the scroll flow path in the circumferential direction, and an introduction portion connecting the return flow path and the scroll flow path, the introduction portion is configured to introduce part of the working fluid flowing in the return flow path into the scroll flow path, in the scroll flow path, an outer flow path forming surface is located on an outermost side in the radial direction and the outer flow path forming surface is formed by a casing inner peripheral surface, and the casing inner peripheral surface faces the inner side of the external casing in the radial direction and faces a diaphragm outer peripheral surface facing the outer side of each of the plurality of diaphragms in the radial direction.

According to the centrifugal compressor of the present disclosure, it is possible to reduce the diameter of the casing while suppressing the pressure loss in the intermediate scroll.

DETAILED DESCRIPTION OF THE INVENTION

Hereinafter, an embodiment for implementing a centrifugal compressor according to the present disclosure will be described with reference to the accompanying drawings. However, the present disclosure is not limited to this embodiment.

(Configuration of Centrifugal Compressor)

Figure 1:
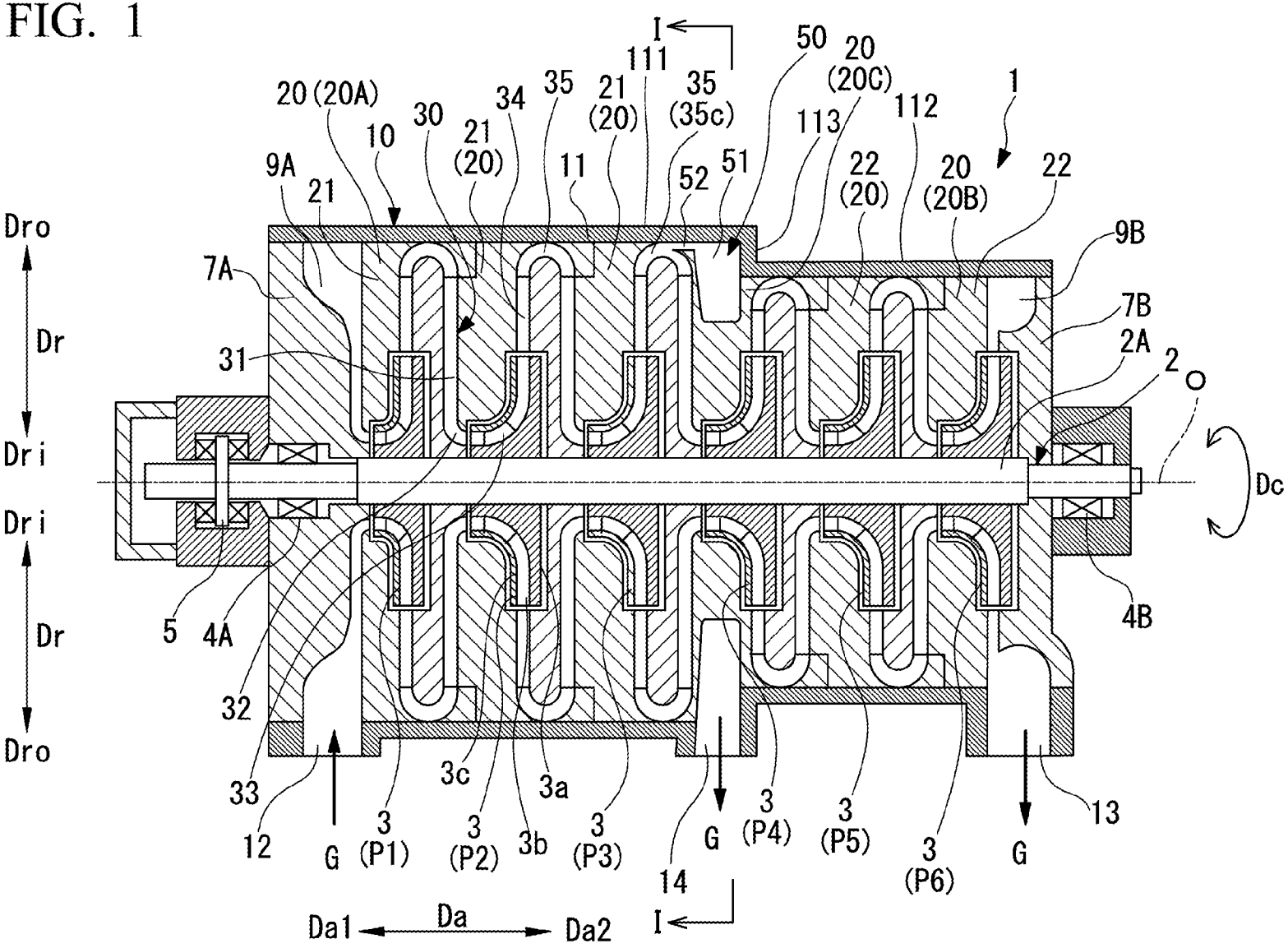
FIG. 1 is a sectional view of a centrifugal compressor according to an embodiment of the present disclosure.

As shown in FIG. 1, a centrifugal compressor 1 in the present embodiment is a uniaxial multi-stage centrifugal compressor. The centrifugal compressor 1 mainly includes a rotary shaft 2 that rotates around a central axis O and a casing 10 that is formed to surround the rotary shaft 2.

The rotary shaft 2 extends in an axial direction Da along which the central axis O extends. The rotary shaft 2 extends to penetrate an inside of the casing 10 along the central axis O. The rotary shaft 2 has a rotary shaft main body 2A and an impeller 3.

The rotary shaft main body 2A is formed in a columnar shape extending in the axial direction Da. An end portion of a first side Da1 in the axial direction Da of the rotary shaft main body 2A is supported by the casing 10 so as to be rotatable around the central axis O by a journal bearing 4A and a thrust bearing 5. An end portion of a second side Da2 in the axial direction Da of the rotary shaft main body 2A is supported by the casing 10 so as to be rotatable around the central axis O by a journal bearing 4B.

The impeller 3 is disposed on an outer side in a radial direction Dr with the central axis O as a reference with respect to the rotary shaft main body 2A. A plurality of impellers 3 are disposed apart from each other in the axial direction Da within the casing 10. In the present embodiment, six impellers 3, for example, are disposed at intervals in the axial direction Da.

Figure 2:
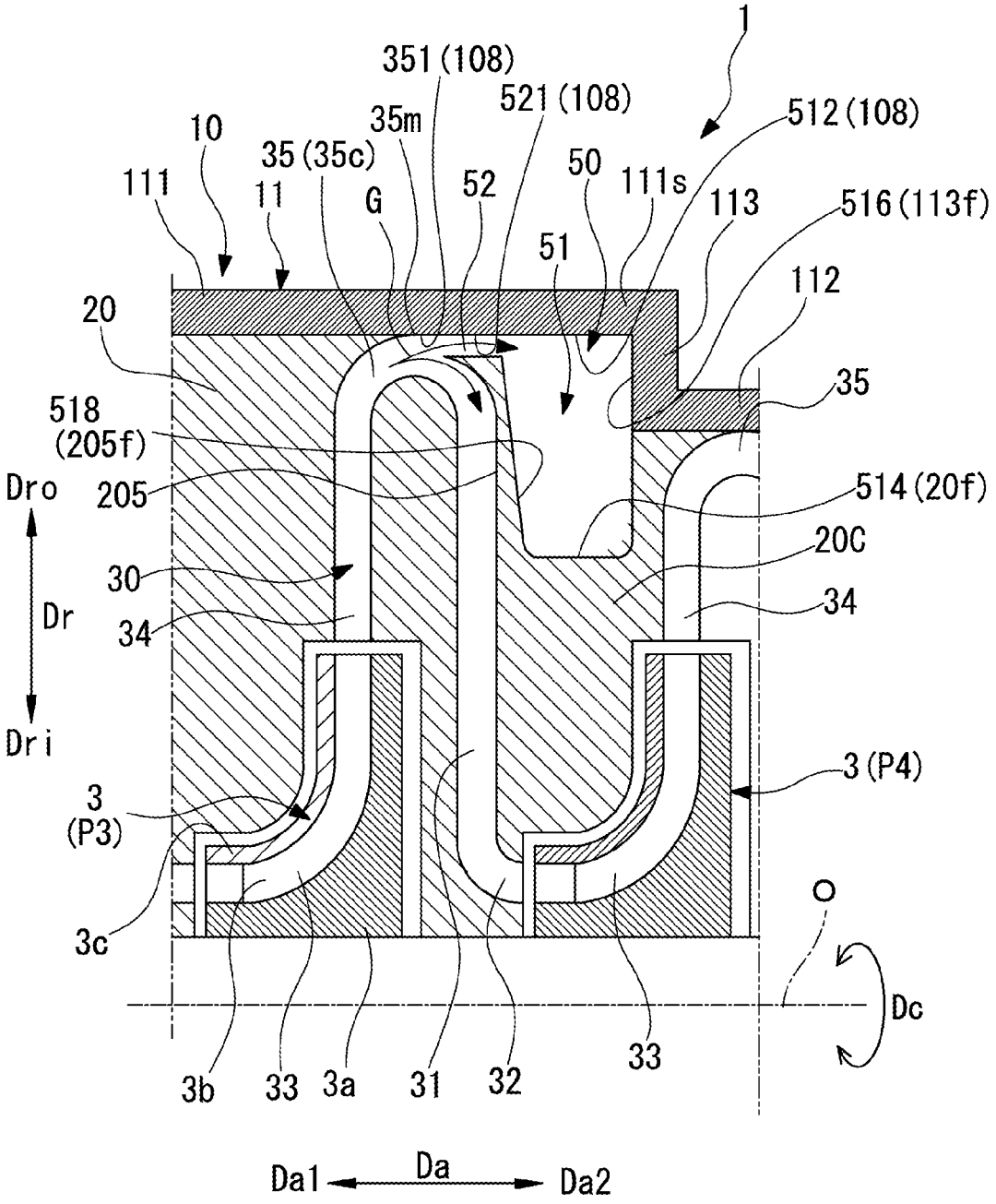
FIG. 2 is an enlarged sectional view showing a configuration around an intermediate scroll of the centrifugal compressor.

Each of the plurality of impellers 3 includes a disk 3*a* having a substantially circular cross section when viewed from the axial direction Da, a plurality of blades 3*b* extending from a surface of the first side Da1 in the axial direction Da of the disk 3*a*, and a shroud 3*c* covering the plurality of blades 3*b* from the first side Da1 in the axial direction Da. Each impeller 3 compresses a working fluid G supplied from the first side Da1 in the axial direction Da with respect to each of the plurality of impellers 3. Each impeller 3 discharges the working fluid G to an outer side Dro in the radial direction Dr with respect to the each of the plurality of impellers 3. As shown in FIG. 2, each impeller 3 has a compression flow path 33 formed therein. The compression flow path 33 is formed by being surrounded by a surface of the disk 3*a* on the first side Da1 in the axial direction Da, a surface of the shroud 3*c* on the second side Da2 in the axial direction Da, and a pair of blades 3*b* adjacent in a circumferential direction. A cross-sectional area of the compression flow path 33 gradually decreases from an inner side Dri of the radial direction Dr toward the outer side Dro of the radial direction Dr. Accordingly, the working fluid G flowing through the compression flow path 33 in a state where the impeller 3 is rotated is gradually compressed to a high pressure. As shown in FIG. 1, each impeller 3 constitutes a compression stage in the centrifugal compressor 1. The centrifugal compressor 1 has a total of six stages, a first compression stage P1 to a sixth compression stage P6. Each impeller 3 may be an open impeller without a shroud.

The casing 10 is formed so as to surround the rotary shaft main body 2A and the plurality of impellers 3 from the outer side Dro of the radial direction Dr. The casing 10 includes an external casing 11, a suction port 12, a discharge port 13, an intermediate discharge port 14, a plurality of diaphragms 20, a first casing head 7A, and a second casing head 7B.

The external casing 11 is formed in a tubular shape extending in the axial direction Da. The external casing 11 is formed to cover the rotary shaft 2 and the plurality of diaphragms 20 from the outer side Dro of the radial direction Dr. The external casing 11 forms the suction port 12, the discharge port 13, and the intermediate discharge port 14.

The suction port 12 is formed on the first side Da1 of the external casing 11 in the axial direction Da. The suction port 12 allows the working fluid G to flow into the external casing 11 from the outside.

The discharge port 13 is formed on the second side Da2 of the external casing 11 in the axial direction Da. The discharge port 13 discharges the working fluid G compressed through the impellers 3 of all the compression stages P1 to P6 in the external casing 11 to the outside of the external casing 11. That is, the discharge port 13 is disposed apart from the suction port 12 on the second side Da2 in the axial direction Da.

The intermediate discharge port 14 is formed between the suction port 12 and the discharge port 13 in the axial direction Da. The intermediate discharge port 14 is formed at a position apart from the suction port 12 and the discharge port 13 in the axial direction Da. As will be described in detail later, the intermediate discharge port 14 discharges the working fluid G compressed through part of the compression stage impellers 3 out of the plurality of impellers 3 of all the compression stages P1 to P6 to the outside of the external casing 11. The intermediate discharge port 14 of the present embodiment discharges the working fluid G compressed through the impellers 3 of part of the compression stages P1 to P3 on the first side Da1 in the axial direction Da to the outside of the external casing 11. The pressure of the working fluid G discharged from the intermediate discharge port 14 is lower than the pressure of the working fluid G compressed by all the impellers 3 and discharged from the discharge port 13.

The plurality of diaphragms 20 are disposed on the inner side Dri in the radial direction Dr of the external casing 11. The plurality of diaphragms 20 are formed in a tubular shape extending in the axial direction Da as a whole so as to cover the impellers 3 of each stage. Each diaphragm 20 is formed in a disk shape centering on the central axis O. The plurality of diaphragms 20 form a casing flow path 30 connecting between a plurality of the impellers 3 by covering surroundings of the rotary shaft 2.

In addition, in the present embodiment, the plurality of diaphragms 20 includes a first diaphragm 21 disposed on the first side Da1 in the axial direction Da in the plurality of diaphragms 20, and a second diaphragm 22 disposed on the second side Da2 in the axial direction Da with respect to the first diaphragm 21. The second diaphragm 22 has a smaller outer diameter in the radial direction Dr than an outer diameter of the first diaphragm 21. In the present embodiment, of the total six compression stages P1 to P6, a plurality (three) of diaphragms 20 covering the impellers 3 of the first compression stage P1 to third compression stage P3 are configured by at least the first diaphragm 21. A plurality (two) of diaphragms 20 covering the impellers 3 of the fifth compression stage P5 and the sixth compression stage P6 are configured by at least the second diaphragm 22.

In addition, in each of the compression stages P1 to P6, the plurality of diaphragms 20 have an introduction flow path 31, a curved flow path 32, a diffuser flow path 34, and a return flow path 35, as the casing flow paths 30, as shown in FIG. 2.

The introduction flow path 31 guides the working fluid G from the outer side Dro in the radial direction Dr toward the inner side Dri in the radial direction Dr. The introduction flow path 31 guides the working fluid G toward the inner side Dri in the radial direction Dr to the impeller 3 via the curved flow path 32.

The curved flow path 32 is connected to the inner side Dri in the radial direction Dr, which is a downstream side of the introduction flow path 31. The curved flow path 32 extends from a position where it is connected to the introduction flow path 31 so as to curve toward the second side Da2 in the axial direction Da. As a result, the flow of the working fluid G toward the inner side Dri in the radial direction Dr changes to the flow toward the second side Da2 in the axial direction Da. The curved flow path 32 deflects the working fluid G flowing from the introduction flow path 31 toward the second side Da2 in the axial direction Da and guides it to the compression flow path 33 of the impeller 3. That is, the curved flow path 32 is connected to the compression flow path 33. The compression flow path 33 is connected to the second side Da2 in the axial direction Da, which is a downstream side of the curved flow path 32. The compression flow path 33 extends from a position where it is connected to the curved flow path 32 so as to curve toward the outer side Dro in the radial direction Dr.

The diffuser flow path 34 extends from the inner side Dri toward the outer side Dro in the radial direction Dr. An end portion of the diffuser flow path 34 on the inner side Dri in the radial direction Dr communicates with an end portion of the compression flow path 33 on the outer side Dro in the radial direction Dr. The diffuser flow path 34 guides the working fluid G compressed by the impeller 3 from the inner side Dri in the radial direction Dr to the outer side Dro in the radial direction Dr.

The return flow path 35 reverses the flow direction of the working fluid G that flowed from the inner side Dri in the radial direction Dr to the outer side Dro in the radial direction Dr through the diffuser flow path 34. The return flow path 35 guides the working fluid G flowing toward the outer side Dro in the radial direction Dr to the inner side Dri in the radial direction Dr so that the flow direction of the working fluid G is directed to the inner side Dri in the radial direction Dr. One end (the first side Da1 in the axial direction Da) of the return flow path 35 upstream of a direction in which the working fluid G flows communicates with the diffuser flow path 34. The other end side (the second side Da2 in the axial direction Da) of the return flow path 35 downstream of the direction in which the working fluid G flows communicates with the following introduction flow path 31.

Furthermore, the external casing 11 has a first tubular portion 111, a second tubular portion 112, and a connection wall portion 113.

The first tubular portion 111 forms a region of the first side Da1 in the axial direction Da in the external casing 11. The first tubular portion 111 is formed to cover the first diaphragm 21 from the outer side Dro in the radial direction Dr. The first tubular portion 111 extends with a constant inner diameter in the axial direction Da.

The second tubular portion 112 is formed on the second side Da2 in the axial direction Da with respect to the first tubular portion 111. That is, the second tubular portion 112 forms a region of the second side Da2 in the axial direction Da in the external casing 11. The second tubular portion 112 is formed to cover the second diaphragm 22 from the outer side Dro in the radial direction Dr. The second tubular portion 112 has a smaller inner diameter in the radial direction Dr than an inner diameter of the first tubular portion 111. The second tubular portion 112 extends with a constant inner diameter in the axial direction Da.

The connection wall portion 113 is formed between the first tubular portion 111 and the second tubular portion 112. The connection wall portion 113 connects the first tubular portion 111 and the second tubular portion 112 in the radial direction Dr. The connection wall portion 113 spreads so as to extend in a direction orthogonal (intersecting) to the axial direction Da. The connection wall portion 113 of the present embodiment is formed in a disk shape extending in the radial direction Dr orthogonal to the axial direction Da when viewed from the axial direction Da.

As shown in FIG. 1, the first casing head 7A is disposed so as to close an opening on the first side Da1 in the axial direction Da of the external casing 11. That is, the first casing head 7A is disposed adjacent to the first side Da1 in the axial direction Da with respect to the plurality of diaphragms 20. Between the first casing head 7A and the diaphragm 20A disposed on the first side Da1 most in the axial direction Da among the plurality of diaphragms 20, a suction scroll 9A is formed to take the working fluid G of the outside into the casing flow path 30 through the suction port 12. The suction scroll 9A connects the suction port 12 and the casing flow path 30. The suction scroll 9A is continuously formed in the circumferential direction Dc in a spiral shape whose cross-sectional area gradually decreases from the suction port 12 toward the casing flow path 30.

The second casing head 7B is disposed so as to close an opening on the second side Da2 in the axial direction Da of the external casing 11. That is, the second casing head 7B is disposed adjacent to the second side Da2 in the axial direction Da with respect to the plurality of diaphragms 20. Between the second casing head 7B and the diaphragm 20B disposed on the second side Da2 most in the axial direction Da among the plurality of diaphragms 20, a discharge scroll 9B for discharging the working fluid G to the outside through the discharge port 13 is formed. The discharge scroll 9B connects the discharge port 13 and the casing flow path 30. The discharge scroll 9B is formed in a spiral shape continuously in the circumferential direction Dc, and is formed in a spiral shape whose cross-sectional area gradually expands from the casing flow path 30 toward the discharge port 13.

Furthermore, the centrifugal compressor 1 has an intermediate scroll 50 at an intermediate portion in the axial direction Da. The intermediate scroll 50 guides part of the working fluid G discharged from the intermediate stage impeller 3 (one of the plurality of impellers 3 in the intermediate stage), which is disposed midway in the axial direction Da among the plurality of impellers 3, to the intermediate discharge port 14. In the present embodiment, the intermediate scroll 50 is disposed between the third compression stage P3 and the fourth compression stage P4. That is, the intermediate scroll 50 guides part of the working fluid G discharged from the impeller 3 of the third compression stage P3 to the intermediate discharge port 14. The intermediate scroll 50 is disposed on inner side Dri in the radial direction Dr of the first tubular portion 111 of the external casing 11. The intermediate scroll 50 includes a scroll flow path 51 and an introduction portion 52.

Figure 3:
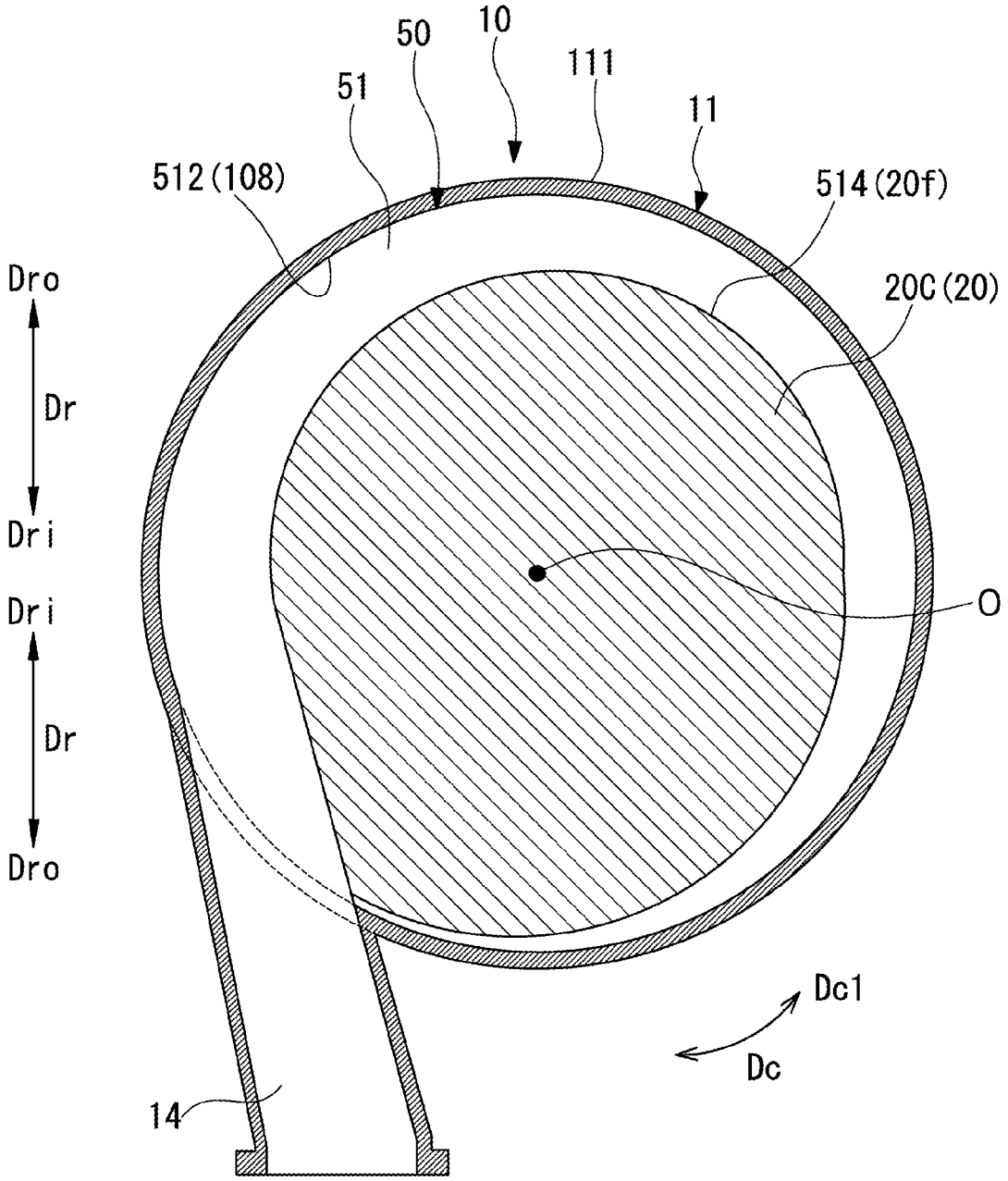
FIG. 3 is a sectional view taken along line I-I of FIG. 1.

As shown in FIG. 2, the scroll flow path 51 is formed on the second side Da2 in the axial direction Da with respect to the return flow path 35C. The scroll flow path 51 is disposed on inner side Dri in the radial direction Dr with respect to the end portion 111*s* of the first tubular portion 111 on the second side Da2 in the axial direction Da. As shown in FIG. 3, the scroll flow path 51 is spirally formed around the central axis O in the circumferential direction Dc. The scroll flow path 51 is formed such that its cross-sectional area gradually expands toward one side Dc1 in the circumferential direction Dc. The scroll flow path 51 is connected to the intermediate discharge port 14 at part the scroll flow path 51 in the circumferential direction Dc.

The scroll flow path 51 is formed on the outer side of the diaphragm 20C in the radial direction Dr, which is disposed between the third compression stage P3 and the fourth compression stage P4. In the scroll flow path 51, an inner flow path forming surface 514 located on the innermost side of the radial direction Dr is formed by a diaphragm outer peripheral surface 20*f* facing the outer side Dro in the radial direction Dr in the diaphragm 20C. The inner flow path forming surface 514 is a surface facing the outer side Dro in the radial direction Dr in the scroll flow path 51.

In the scroll flow path 51, an outer flow path forming surface 512 is located on the outermost side of the radial direction Dr. The outer flow path forming surface 512 is formed by the casing inner peripheral surface 108 facing the inner side Dri in the radial direction Dr in the first tubular portion 111 of the external casing 11. The casing inner peripheral surface 108 faces the diaphragm outer peripheral surface 20*f* of the diaphragm 20C in the radial direction Dr. The outer flow path forming surface 512 is a surface facing the inner side Dri in the radial direction Dr in the scroll flow path 51.

As shown in FIG. 2, a second side flow path forming surface 516 is located on the second side Da2 in the axial direction Da in the scroll flow path 51. The second side flow path forming surface 516 is formed by an inner wall surface 113*f* facing the first side Da1 in the axial direction Da in the connection wall portion 113. The second side flow path forming surface 516 is a surface facing the first side Da1 in the axial direction Da in the scroll flow path 51.

The diaphragm 20C forming the scroll flow path 51 includes an extending portion 205 that partitions the scroll flow path 51 and the return flow path 35C in the axial direction Da. That is, at least one of the plurality of diaphragms 20 includes the extending portion 205. The extending portion 205 extends from the first side Da1 in the axial direction Da of the inner flow path forming surface 514 to the outer side Dro in the radial direction Dr. In the scroll flow path 51, a first side flow path forming surface 518 located on the first side Da1 in the axial direction Da is formed by an extending wall surface 205*f* facing the second side Da2 in the axial direction Da in the extending portion 205. The first side flow path forming surface 518 is a surface facing the second side Da2 in the axial direction Da in the scroll flow path 51.

The introduction portion 52 connects the return flow path 35C and the scroll flow path 51. The introduction portion 52 introduces part of the working fluid G flowing through the return flow path 35C into the scroll flow path 51. The introduction portion 52 extends straight in the axial direction Da from the maximum diameter portion 35*m* of the outermost side in the radial direction Dr in the return flow path 35C. The introduction portion 52 is formed on the outer side Dro in the radial direction Dr with respect to the extending portion 205. The introduction portion 52 has an introduction portion outer flow path forming surface 521. In the present embodiment, at least part of the introduction portion outer flow path forming surface 521 located on the outermost side of the radial direction Dr in the introduction portion 52 is formed by the casing inner peripheral surface 108.

The flow path cross-sectional area of the introduction portion 52 as viewed from the axial direction Da (or a flow path width of the radial direction Dr of the introduction portion 52 as viewed from the circumferential direction Dc) may be set appropriately based on a ratio of a flow rate of the working fluid G to be supplied to the scroll flow path 51 to a flow rate (supplied to the next impeller 3) supplied from the return flow path 35 to the next introduction flow path 31.

In addition, at least part of a flow path inner surface 351 forming the maximum diameter portion 35*m* of the return flow path 35 is formed by the casing inner peripheral surface 108. That is, a position of the maximum diameter portion 35*m* of the return flow path 35 in the radial direction Dr is the same position as the outer flow path forming surface 512 that is on the outermost side Dro in the radial direction Dr in the scroll flow path 51.

In such an intermediate scroll 50, part of the working fluid G whose pressure has increased by passing through the first compression stage P1 to the third compression stage P3 flows into the scroll flow path 51 through the introduction portion 52 from the return flow path 35C. The working fluid G flows along the scroll flow path 51 toward one side Dc1 in the circumferential direction Dc and is discharged from the intermediate discharge port 14 to the outside.

(Operation and Effect)

The centrifugal compressor 1 configured as described above includes the intermediate scroll 50 that guides part of the working fluid G discharged from the intermediate stage impeller 3 to the intermediate discharge port 14. In the scroll flow path 51 of the intermediate scroll 50, the outer flow path forming surface 512 located on the outermost side in the radial direction Dr is formed by the casing inner peripheral surface 108. Furthermore, the casing inner peripheral surface 108 faces the inner side Dri in the radial direction Dr in the external casing 11 so as to face the diaphragm outer peripheral surface 20*f*, which faces the outer side Dro in the radial direction Dr, in the diaphragm 20. That is, a region of the outer side Dro in the radial direction Dr of the scroll flow path 51 is formed by the external casing 11 instead of the diaphragm 20. Therefore, it is not necessary to increase the size of the diaphragm 20 in the radial direction Dr just to form the scroll flow path 51, and the size of the diaphragm 20 can be reduced. Furthermore, since the outer flow path forming surface 512 is the casing inner peripheral surface 108 facing the diaphragm outer peripheral surface 20*f*, the outer flow path forming surface 512 is formed on the innermost side Dri in the radial direction Dr closest to the diaphragm 20 in the external casing 11. Therefore, the size of the diaphragm 20 can be reduced, and the scroll flow path 51 can be formed as large as possible in the radial direction Dr. Therefore, it is possible to reduce the diameter of the casing 10 while ensuring performance of the intermediate scroll 50. Furthermore, the external casing 11 can sufficiently ensure pressure-resistant performance of the scroll flow path 51.

In addition, the scroll flow path 51 is formed on the second side Da2 in the axial direction Da with respect to the return flow path 35C. Therefore, the introduction portion 52 discharges the working fluid G toward the second side Da2 in the axial direction Da from the return flow path 35C toward the scroll flow path 51. Therefore, an inertia caused by the flow of the working fluid G flowing through the return flow path 35C can be used to allow the working fluid G to flow smoothly from the introduction portion 52 into the scroll flow path 51. Therefore, pressure loss of the working fluid G when flowing into the intermediate scroll 50 can be suppressed. Therefore, it is possible to reduce the diameter of the casing 10 while suppressing the pressure loss in the intermediate scroll 50.

In addition, the external casing 11 includes the first tubular portion 111 covering the first diaphragm 21 and a second tubular portion 112 covering the second diaphragm 22 having a smaller outer diameter in the radial direction Dr than the first diaphragm 21. The connection wall portion 113 is formed between the first tubular portion 111 and the second tubular portion 112. Furthermore, the second side flow path forming surface 516 of the scroll flow path 51 is formed by the inner wall surface 113*f* of the connection wall portion 113 facing the first side Da1 in the axial direction Da. That is, a region of the scroll flow path 51 on the second side Da2 in the axial direction Da is formed not by the diaphragm 20 but by the connection wall portion 113 that is part of the external casing 11. Therefore, it is not necessary to increase the size of the diaphragm 20 in the axial direction Da just to form the scroll flow path 51, and the size of the diaphragm 20 can be reduced. Accordingly, it becomes possible to miniaturize the casing 10 in the axial direction Da.

In addition, the introduction portion 52 of the intermediate scroll 50 extends from the maximum diameter portion 35*m* of the return flow path 35 in the axial direction Da. The working fluid G flowing through the return flow path 35 flows so as to be gathered on the outer side Dro in the radial direction Dr by centrifugal force. However, in the present embodiment, the introduction portion 52 extends from the maximum diameter portion 35*m* of the return flow path 35 in the axial direction Da. As a result, the working fluid G flowing in the outer side Dro in the radial direction Dr of the return flow path 35 flows into the introduction portion 52 from the maximum diameter portion 35*m* of the return flow path 35 with momentum that has flowed through the return flow path 35. Therefore, a dynamic pressure of the working fluid G when flowing into the introduction portion 52 is suppressed. Furthermore, at least part of the introduction portion outer flow path forming surface 521 of the introduction portion 52 is formed by the casing inner peripheral surface 108. Accordingly, a surface of the outer side Dro in the radial direction Dr that defines the introduction portion 52 extends straight in the axial direction Da. Therefore, a dynamic pressure of the working fluid G flowing in the introduction portion 52 can be suppressed. Therefore, the pressure loss in the introduction portion 52 can be suppressed, and the pressure loss in the intermediate scroll 50 can be reduced.

In addition, at least part of the flow path inner surface 351 of the maximum diameter portion 35*m* of the return flow path 35 is formed by the casing inner peripheral surface 108. That is, the flow path inner surface 351 of the maximum diameter portion 35*m* of the return flow path 35 and the introduction portion outer flow path forming surface 521 of the introduction portion 52 are formed by the same surface. Accordingly, the dynamic pressure of the working fluid G when it flows from the return flow path 35 into the introduction portion 52 can be further suppressed. Therefore, the pressure loss in the introduction portion 52 can be suppressed, and the pressure loss in the intermediate scroll 50 can be further reduced.

In addition, the scroll flow path 51 has an inner flow path forming surface 514 formed by the diaphragm outer peripheral surface 20*f* of the diaphragm 20C. Therefore, in a region where the diaphragm 20C overlaps the position where the scroll flow path 51 is formed in the axial direction Da, the diaphragm 20C does not need to extend in the radial direction Dr to the same position as the casing inner peripheral surface 108, as long as it has the outer diameter of the radial direction Dr corresponding to the position where the inner flow path forming surface 514 of the scroll flow path 51 is formed. Therefore, the size of the diaphragm 20C in the radial direction Dr at the position where the scroll flow path 51 is formed can be suppressed.

Modification Example of First Embodiment

Although the introduction portion 52 is provided in the above-described first embodiment, the introduction portion 52 can be configured as shown below, for example.

Figure 4:
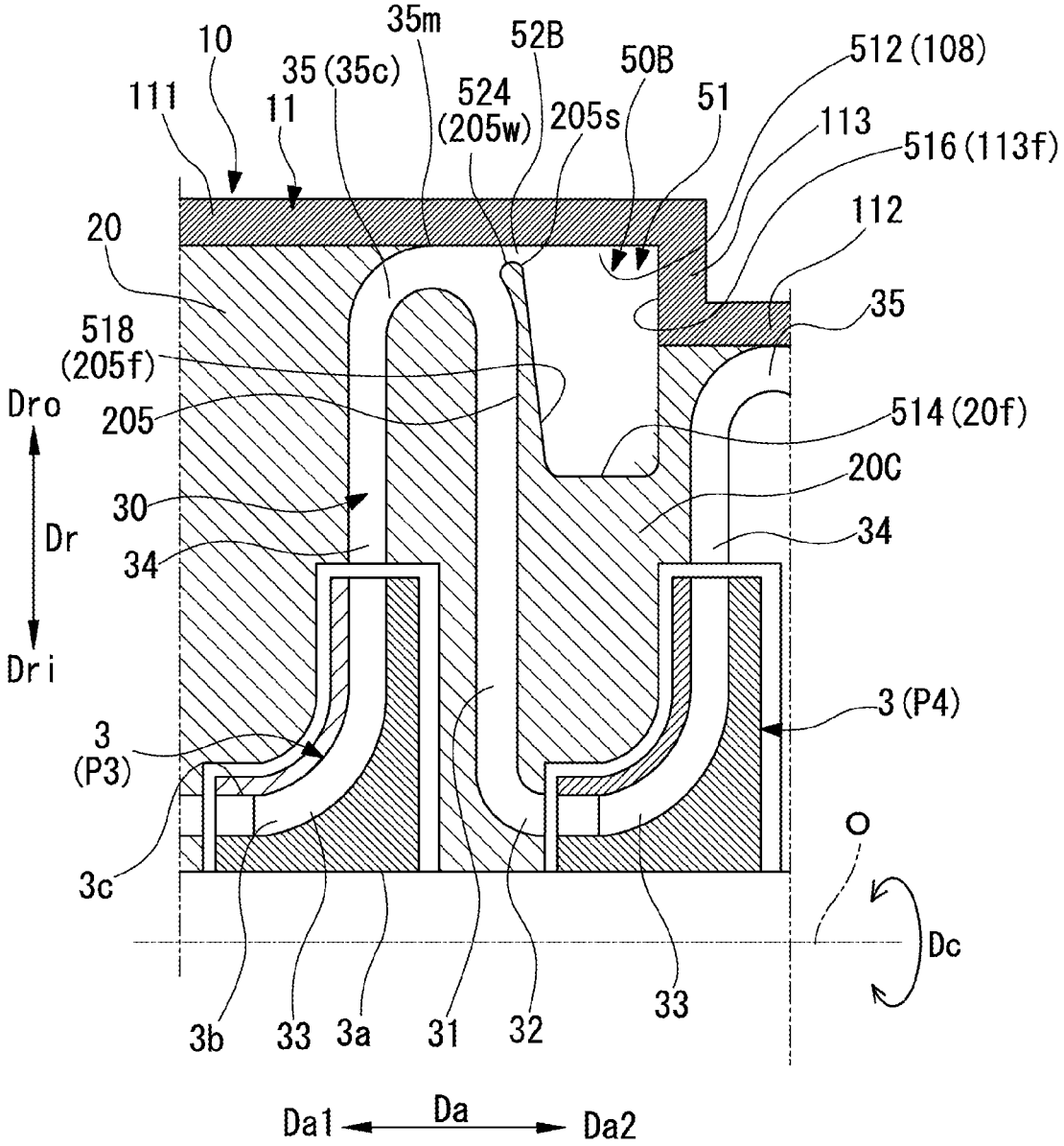
FIG. 4 is a sectional view showing a modification example of an introduction portion of the intermediate scroll.

As shown in FIG. 4, the introduction portion 52B of the intermediate scroll SOB is formed between a tip portion 205*s* of the extending portion 205 formed in the diaphragm 20C and the casing inner peripheral surface 108 of the first tubular portion 111 of the external casing 11. In the present modification example, the tip portion 205*s* of the extending portion 205 is formed to have a shorter length in the axial direction Da compared with the configuration of FIG. 2 in the above-described embodiment. In the present modification example, the tip portion 205*s* is formed only by a curved surface 205*w* protruding toward the outer side Dro in the radial direction Dr.

In this case, the introduction portion inner flow path forming surface 524 of the radial direction Dr in the introduction portion 52B that is located at the innermost side is the curved surface 205*w* formed at the tip portion 205*s* of the extending portion 205 when viewed from the circumferential direction Dc.

Even in such a configuration, the curved surface 205*w* can form the introduction portion inner flow path forming surface 524 of the introduction portion 52B. Accordingly, the working fluid G introduced from the return flow path 35 into the scroll flow path 51 smoothly flows along the curved surface 205*w*, so that a pressure loss of the introduction portion 52B on the inner side Dri in the radial direction Dr can be suppressed.

Other Embodiments

The embodiments of the present disclosure have been described in detail above with reference to the drawings. However, the specific configuration is not limited to these embodiments, and design changes and the like within a scope which does not depart from the gist of the present disclosure are also included.

In the above-described embodiment, the external casing 11 includes the first tubular portion 111, the second tubular portion 112, and the connection wall portion 113, and the second side flow path forming surface 516 of the scroll flow path 51 is formed by the inner wall surface 113*f* of the connection wall portion 113, but the present disclosure is not limited to this. For example, in a case where the external casing 11 is formed with a constant outer diameter throughout the axial direction Da, the second side flow path forming surface 516 of the scroll flow path 51 may be formed by other diaphragms located on the second side Da2 in the axial direction Da.

Additional Remark

For example, the centrifugal compressor 1 described in the embodiment is understood as follows.

(1) A centrifugal compressor 1 according to a first aspect includes a rotary shaft 2 extending in an axial direction Da in which a central axis O extends, and a casing 10 having a suction port 12 formed on a first side Da1 in the axial direction Da in the casing 10, a discharge port 13 formed on a second side Da2 in the axial direction Da in the casing 10, and an intermediate discharge port 14 formed between the suction port 12 and the discharge port 13 in the axial direction Da. The rotary shaft 2 has a plurality of impellers 3 that are disposed in the casing 10 at a distance in the axial direction Da, that configured to compress a working fluid G supplied from the first side Da1 in the axial direction Da with respect to each of the plurality of impellers 3, and that configured to discharge the working fluid G to an outer side Dro in a radial direction Dr with the central axis O as a reference with respect to the each of the plurality of impellers 3. The casing 10 has a plurality of diaphragms 20 formed in a tubular shape extending in the axial direction Da to cover the each of the plurality of impellers 3, an external casing 11 formed in a tubular shape extending in the axial direction Da to cover the plurality of diaphragms 20, a return flow path 35 that configured to guide the working fluid G, which is discharged from each of the plurality of impellers 3 and is flowing toward the outer side Dro in the radial direction Dr, so that a flow direction of the working fluid G is directed to an inner side Dro in the radial direction Dr, and an intermediate scroll 50 that configured to guide part of the working fluid G discharged from one of the plurality of impellers 3 in an intermediate stage which is disposed midway in the axial direction Da among the plurality of impellers 3 to the intermediate discharge port 14. The intermediate scroll 50 has a scroll flow path 51 formed on the second side Da2 in the axial direction Da with respect to the return flow path 35, extending in a circumferential direction Dc around the central axis O and connected to the intermediate discharge port 14 at part of the scroll flow path 51 in the circumferential direction Dc, and an introduction portion 52 connecting the return flow path 35 and the scroll flow path 51. The introduction portion 52 is configured to introduce part of the working fluid G flowing in the return flow path 35 into the scroll flow path 51. In the scroll flow path 51, an outer flow path forming surface 512 is located on an outermost side in the radial direction Dr and the outer flow path forming surface 512 is formed by a casing inner peripheral surface 108. And, the casing inner peripheral surface 108 faces the inner side Dri of the external casing 11 in the radial direction Dr and faces a diaphragm outer peripheral surface 20*f* facing the outer side Dro of each of the plurality of diaphragms 20C in the radial direction Dr.

As a result, a region of the outer side Dro in the radial direction Dr of the scroll flow path 51 is formed by the external casing 11 instead of the diaphragm 20. Therefore, it is not necessary to increase the size of the diaphragm 20 in the radial direction Dr just to form the scroll flow path 51, and the size of the diaphragm 20 can be reduced. Furthermore, since the outer flow path forming surface 512 is the casing inner peripheral surface 108 facing the diaphragm outer peripheral surface 20*f*, the outer flow path forming surface 512 is formed on the innermost side Dri in the radial direction Dr closest to the diaphragm 20 in the external casing 11. Therefore, the size of the diaphragm 20 can be reduced, and the scroll flow path 51 can be formed as large as possible in the radial direction Dr. Therefore, it is possible to reduce the diameter of the casing 10 while ensuring the performance of the intermediate scroll 50. Furthermore, the external casing 11 can sufficiently ensure the pressure-resistant performance of the scroll flow path 51.

In addition, the scroll flow path 51 is formed on the second side Da2 in the axial direction Da with respect to the return flow path 35C. Therefore, the introduction portion 52 discharges the working fluid G toward the second side Da2 in the axial direction Da from the return flow path 35C toward the scroll flow path 51. Therefore, the inertia caused by the flow of the working fluid G flowing through the return flow path 35C can be used to allow the working fluid G to flow smoothly from the introduction portion 52 into the scroll flow path 51. Therefore, the pressure loss of the working fluid G when flowing into the intermediate scroll 50 can be suppressed. Therefore, it is possible to reduce the diameter of the casing 10 while suppressing the pressure loss in the intermediate scroll 50.

(2) A centrifugal compressor 1 according to a second aspect is the centrifugal compressor 1 according to (1), in which the plurality of diaphragms 20 has a first diaphragm 21 disposed on the first side Da1 in the axial direction Da in the plurality of diaphragms 21, and a second diaphragm 22 disposed on the second side Da2 in the axial direction Da with respect to the first diaphragm 21 and having a smaller outer diameter in the radial direction Dr than an outer diameter of the first diaphragm 21. The casing 10 has a first tubular portion 111 covering the first diaphragm 21, a second tubular portion 112 covering the second diaphragm 22 and having a smaller inner diameter in the radial direction Dr than an inner diameter of the first tubular portion 111, and a connection wall portion 113 formed between the first tubular portion 111 and the second tubular portion 112 and extending in a direction intersecting the axial direction Da, and connecting the first tubular portion 111 and the second tubular portion 112. And a second side flow path forming surface 516 is located on the second side Da2 in the axial direction Da in the scroll flow path 51 is formed by an inner wall surface 113*f* of the connection wall portion 113, which faces the first side Da1 in the axial direction Da in the connection wall portion 113.

Accordingly, a region of the scroll flow path 51 on the second side Da2 in the axial direction Da is formed not by the diaphragm 20 but by the connection wall portion 113 that is part of the external casing 11. Therefore, it is not necessary to increase the size of the diaphragm 20 in the axial direction Da just to form the scroll flow path 51, and the size of the diaphragm 20 can be reduced. Accordingly, it becomes possible to miniaturize the casing 10 in the axial direction Da.

(3) A centrifugal compressor 1 according to a third aspect is the centrifugal compressor 1 according to (1) or (2), in which the introduction portion 52 has an introduction portion outer flow path forming surface 521 extending in the axial direction Da from a maximum diameter portion 35*m* of the outermost side in the radial direction Dr in the return flow path 35, and at least part of the introduction portion outer flow path forming surface 521 is located on the outermost side in the radial direction Dr is formed by the casing inner peripheral surface 108.

The working fluid G flowing through the return flow path 35 flows so as to be gathered on the outer side Dro in the radial direction Dr by centrifugal force. However, the introduction portion 52 extends from the maximum diameter portion 35*m* of the return flow path 35 in the axial direction Da. As a result, the working fluid G flowing in the outer side Dro in the radial direction Dr of the return flow path 35 flows into the introduction portion 52 from the maximum diameter portion 35*m* of the return flow path 35 with the momentum that has flowed through the return flow path 35. Therefore, the dynamic pressure of the working fluid G when flowing into the introduction portion 52 is suppressed. Furthermore, at least part of the introduction portion outer flow path forming surface 521 of the introduction portion 52 is formed by the casing inner peripheral surface 108. Accordingly, the surface of the outer side Dro in the radial direction Dr that defines the introduction portion 52 extends straight in the axial direction Da. Therefore, the dynamic pressure of the working fluid G flowing in the introduction portion 52 can be suppressed. Therefore, the pressure loss in the introduction portion 52 can be suppressed, and the pressure loss in the intermediate scroll 50 can be reduced.

(4) A centrifugal compressor 1 according to a fourth aspect is the centrifugal compressor 1 according to (3), in which at least part of a flow path inner surface 351 of the maximum diameter portion 35*m* of the return flow path 35 is formed by the casing inner peripheral surface 108.

Accordingly, the flow path inner surface 351 of the maximum diameter portion 35*m* of the return flow path 35 and the introduction portion outer flow path forming surface 521 of the introduction portion 52 are formed by the same surface. Accordingly, the dynamic pressure of the working fluid G when it flows from the return flow path 35 into the introduction portion 52 can be further suppressed. Therefore, the pressure loss in the introduction portion 52 can be suppressed, and the pressure loss in the intermediate scroll 50 can be further reduced.

(5) A centrifugal compressor 1 according to a fifth aspect is the centrifugal compressor 1 according to any one of (1) to (4), in which an inner flow path forming surface 514 is located on an innermost side in the radial direction Dr in the scroll flow path 51 and is formed by each of the plurality of diaphragms 20C.

Accordingly, in a region where the diaphragm 20C overlaps the position where the scroll flow path 51 is formed in the axial direction Da, the diaphragm 20C does not need to extend in the radial direction Dr to the same position as the casing inner peripheral surface 108, as long as it has the outer diameter of the radial direction Dr corresponding to the position where the inner flow path forming surface 514 of the scroll flow path 51 is formed. Therefore, the size of the diaphragm 20C in the radial direction Dr at the position where the scroll flow path 51 is formed can be suppressed.

(6) A centrifugal compressor 1 according to a sixth aspect is the centrifugal compressor 1 according to any one of (1) to (5), in which at least one of the plurality of diaphragms 20C includes an extending portion 205 extending toward the outer side Dro in the radial direction Dr and partitioning the return flow path 35 and the scroll flow path 51 in the axial direction Da, on the first side Da1 in the axial direction Da with respect to the scroll flow path 51. An introduction portion inner flow path forming surface 524 is located on an innermost side in the radial direction Dr in the introduction portion 52B and is a curved surface 205*w*. And, the curved surface 205*w* is formed at a tip portion 205*s* of the extending portion 205 on the outer side Dro in the radial direction Dr and protrudes toward the outer side Dro in the radial direction Dr, when viewed from the circumferential direction Dc.

Accordingly, the curved surface 205*w* can form the introduction portion inner flow path forming surface 524 of the introduction portion 52B. Accordingly, the working fluid G introduced from the return flow path 35 into the scroll flow path 51 smoothly flows along the curved surface 205*w*, so that the pressure loss of the introduction portion 52B on the inner side Dri in the radial direction Dr can be suppressed.

INDUSTRIAL APPLICABILITY

According to the centrifugal compressor of the present disclosure, it is possible to reduce the diameter of the casing while suppressing the pressure loss in the intermediate scroll.

EXPLANATION OF REFERENCES

1: Centrifugal compressor
2: Rotary shaft
2A: Rotary shaft main body
3: Impeller
3*a*: Disk
3*b*: Blade
3*c*: Shroud
4A, 4B: Journal bearing
5: Thrust bearing
7A: First casing head
7B: Second casing head
9A: Suction scroll
9B: Discharge scroll
10: Casing
11: External casing
111: First tubular portion
111*s*: End portion
112: Second tubular portion
113: Connection wall portion
113*f*: Inner wall surface
12: Suction port
13: Discharge port
14: Intermediate discharge port
20, 20A, 20B, 20C: Diaphragm
20*f*: Diaphragm outer peripheral surface
205: Extending portion
205*f*: Extending wall surface
205*s*: Tip portion
205*w*: Curved surface
21: First diaphragm
22: Second diaphragm
30: Casing flow path
31: Introduction flow path
32: Curved flow path
33: Compression flow path
34: Diffuser flow path
35, 35C: Return flow path
351: Flow path inner surface
35*m*: Maximum diameter portion
50, 50B: Intermediate scroll
51: Scroll flow path
52, 52B: Introduction portion
108: Casing inner peripheral surface
512: Outer flow path forming surface
514: Inner flow path forming surface
516: Second side flow path forming surface
518: First side flow path forming surface
521: Introduction portion outer flow path forming surface
524: Introduction portion inner flow path forming surface
Da: Axial direction
Da1: First side
Da2: Second side
Dc: Circumferential direction
Dc1: One side
Dr: Radial direction
Dri: Inner side
Dro: Outer side
G: Working fluid
O: Central axis
P1 to P6: Compression stage

What is claimed is:

1. A centrifugal compressor comprising:

a rotary shaft extending in an axial direction in which a central axis extends; and a casing having a suction port formed on a first side in the axial direction in the casing, a discharge port formed on a second side in the axial direction in the casing, and an intermediate discharge port formed between the suction port and the discharge port in the axial direction, wherein the rotary shaft has a plurality of impellers that are disposed in the casing at a distance in the axial direction, that configured to compress a working fluid supplied from the first side in the axial direction with respect to each of the plurality of impellers, and that configured to discharge the working fluid to an outer side in a radial direction with the central axis as a reference with respect to the each of the plurality of impellers, the casing has a plurality of diaphragms formed in a tubular shape extending in the axial direction to cover the each of the plurality of impellers, an external casing formed in a tubular shape extending in the axial direction to cover the plurality of diaphragms, a return flow path that is configured to guide the working fluid, which is discharged from each of the plurality of impellers and is flowing toward the outer side in the radial direction, so that a flow direction of the working fluid is directed to an inner side in the radial direction, and an intermediate scroll that is configured to guide part of the working fluid discharged from one of the plurality of impellers in an intermediate stage which is disposed midway in the axial direction among the plurality of impellers to the intermediate discharge port, the intermediate scroll has a scroll flow path formed on the second side in the axial direction with respect to the return flow path, extending in a circumferential direction around the central axis, and connected to the intermediate discharge port at part of the scroll flow path in the circumferential direction, and an introduction portion connecting the return flow path and the scroll flow path, the introduction portion is configured to introduce part of the working fluid flowing through the return flow path into the scroll flow path, in the scroll flow path, an outer flow path forming surface is located on an outermost side in the radial direction and the outer flow path forming surface is formed by a casing inner peripheral surface, the casing inner peripheral surface faces the inner side of the external casing in the radial direction and faces a diaphragm outer peripheral surface facing the outer side of each of the plurality of diaphragms in the radial direction, the plurality of diaphragms has a first diaphragm disposed on the first side in the axial direction in the plurality of diaphragms, and a second diaphragm disposed on the second side in the axial direction with respect to the first diaphragm and having a smaller outer diameter in the radial direction than an outer diameter of the first diaphragm, the casing has a first tubular portion covering the first diaphragm, a second tubular portion covering the second diaphragm and having a smaller inner diameter in the radial direction than an inner diameter of the first tubular portion, and a connection wall portion formed between the first tubular portion and the second tubular portion, extending in a direction intersecting the axial direction, and connecting the first tubular portion and the second tubular portion, and a second side flow path forming surface located on the second side in the axial direction in the scroll flow path is formed by an inner wall surface of the connection wall portion, which faces the first side in the axial direction in the connection wall portion.

2. The centrifugal compressor according to claim 1, wherein the introduction portion has an introduction portion outer flow path forming surface extending in the axial direction from a maximum diameter portion of the outermost side in the radial direction in the return flow path, and at least part of the introduction portion outer flow path forming surface located on the outermost side in the radial direction is formed by the casing inner peripheral surface.

3. The centrifugal compressor according to claim 2, wherein at least part of a flow path inner surface of the maximum diameter portion of the return flow path is formed by the casing inner peripheral surface.

4. The centrifugal compressor according to claim 1, wherein an inner flow path forming surface is located on an innermost side in the radial direction in the scroll flow path and is formed by one of the plurality of diaphragms.

5. The centrifugal compressor according to claim 1, wherein at least one of the plurality of diaphragms includes an extending portion extending toward the outer side in the radial direction and partitioning the return flow path and the scroll flow path in the axial direction, on the first side in the axial direction with respect to the scroll flow path, an introduction portion inner flow path forming surface is located on an innermost side in the radial direction in the introduction portion and is a curved surface, and the curved surface is formed at a tip portion of the extending portion on the outer side in the radial direction and protrudes toward the outer side in the radial direction, when viewed from the circumferential direction.

* * * * *